US010422494B2

(12) United States Patent
Moghal et al.

(10) Patent No.: US 10,422,494 B2
(45) Date of Patent: Sep. 24, 2019

(54) HIGH MAST LUMINAIRE

(71) Applicant: Eaton Intelligent Power Limited, Dublin OT (IE)

(72) Inventors: Khurram Z. Moghal, Senoia, GA (US); Bobby Brooks, Senoia, GA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 15/964,880

(22) Filed: Apr. 27, 2018

(65) Prior Publication Data

US 2018/0320847 A1 Nov. 8, 2018

Related U.S. Application Data

(60) Provisional application No. 62/500,743, filed on May 3, 2017.

(51) Int. Cl.

| | |
|---|---|
| ***F21S 8/08*** | (2006.01) |
| ***F21V 31/03*** | (2006.01) |
| ***F21V 15/015*** | (2006.01) |
| ***F21V 15/00*** | (2015.01) |
| ***F21V 23/06*** | (2006.01) |
| ***F21V 19/00*** | (2006.01) |
| ***F21V 29/77*** | (2015.01) |
| ***F21V 23/00*** | (2015.01) |
| ***F21V 17/12*** | (2006.01) |
| ***F21V 25/10*** | (2006.01) |

(Continued)

(52) U.S. Cl.

CPC ..... *F21S 8/086* (2013.01); *F21V 15/005* (2013.01); *F21V 15/015* (2013.01); *F21V 19/0055* (2013.01); *F21V 23/06* (2013.01); *F21V 29/77* (2015.01); *F21V 31/03* (2013.01); *F21V 17/12* (2013.01); *F21V 23/001* (2013.01); *F21V 23/009* (2013.01); *F21V 25/10* (2013.01); *F21W 2131/103* (2013.01); *F21Y 2115/10* (2016.08)

(58) Field of Classification Search

CPC .. F21S 8/08–8/088; F21V 21/02–21/06; F21V 15/00–15/04; F21V 17/08; F21V 17/02; F21V 29/503; F21V 29/83

See application file for complete search history.

(56) References Cited

U.S. PATENT DOCUMENTS 9,435,527 B1 * 9/2016 Kluska ..... F21V 3/00
9,518,724 B2 * 12/2016 Kwak ..... F21V 5/04

(Continued)

OTHER PUBLICATIONS

Cree Edge Series Specification Sheet; Jan. 3, 2018.

(Continued)

*Primary Examiner* — Mariceli Santiago

(74) *Attorney, Agent, or Firm* — King & Spalding LLP

(57) ABSTRACT

A luminaire includes a light emitting diode module, a driver housing, and a hollow connector that connects the driver housing and the light emitting diode module. The driver housing includes a rotatable cap and a driver that provides power to the light emitting diode module. The rotatable cap permits rotation of the hollow connector and the light emitting diode module in order to direct the light from the light emitting diode module in a desired direction. The light emitting diode module includes a plurality of optics wherein each optic covers at least one light emitting diode and at least one vent adjacent to each optic.

25 Claims, 13 Drawing Sheets

(51) Int. Cl.
*F21Y 115/10* (2016.01)
*F21W 131/103* (2006.01)

(56) References Cited

U.S. PATENT DOCUMENTS

2016/0131356 A1* 5/2016 Engberg ..... F21V 29/76
362/373
2017/0248296 A1* 8/2017 Sekowski ..... F21V 21/30

OTHER PUBLICATIONS

GE Evolve: LED Roadway Lighting, High Mast Luminaire (ERHM) Brochure; Oct. 23, 2017.
Philips Lighting; Lumec, Roadway, HighFocus; Specification Sheet; Nov. 2017.
Holophane: HMLED2, LED High Mast Lighting Specification sheet; Jun. 23, 2016.
"CondorLED 2 High Mast LED Luminaire" Carolina High Mast. Retrieved Apr. 10, 2019. https://www.carolinahighmast.com/luminaires 3 pages.
"Condor CLED2: 2$^{nd}$ Generation LED High Mast Luminaire" Carolina High Mast. www.carolinahighmast.com. Revision May 24, 2018.

* cited by examiner

HIGH MAST LUMINAIRE

RELATED APPLICATIONS

The present application claims priority under 35 U.S.C. § 119 to U.S. Provisional Patent Application No. 62/500,743, titled "High Mast Luminaire", and filed on May 3, 2017, the entire contents of which are incorporated herein by reference.

TECHNICAL FIELD

Embodiments described herein relate generally to light fixtures, and more particularly to systems, methods, and devices for a high mast luminaire.

BACKGROUND

When compared to conventional lighting technologies, such as incandescent, fluorescent, halogen, metal halide, or high pressure sodium light sources, light emitting diodes (LEDs) offer substantial benefits associated with their energy efficiency, light quality, and compact size. However, new technologies can help to realize the full potential benefits offered by light emitting diodes. For example, technologies that allow control over the direction of light emitted from LEDs would be beneficial. Additionally, technologies for handling the heat emitted by LEDs would also be beneficial.

SUMMARY

In one example embodiment, a luminaire comprises a light emitting diode module with a plurality of optics, each optic covering one or more LEDs, and each optic separated from the other optics by a vent. The luminaire further comprises a driver housing comprising a driver and a rotatable cap for rotating the LED module and a hollow connector for connecting the LED module and the rotatable cap of the driver housing.

In another example embodiment, a luminaire comprises a driver housing with a driver, a rotatable cap, and a mounting assembly. The luminaire further comprises an LED module with a plurality of optics wherein each optic of the plurality of optics covers one or more LEDs. The LED module and the driver housing are connected by a hollow connector wherein the hollow connector and the LED module are rotatable by the rotatable cap.

These and other aspects, objects, features, and embodiments, will be apparent from the following description and the appended claims.

BRIEF DESCRIPTION OF THE DRAWINGS

The drawings illustrate only example embodiments of high mast luminaires and are therefore not to be considered limiting of its scope and may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION OF EXAMPLE EMBODIMENTS

Figure 1:
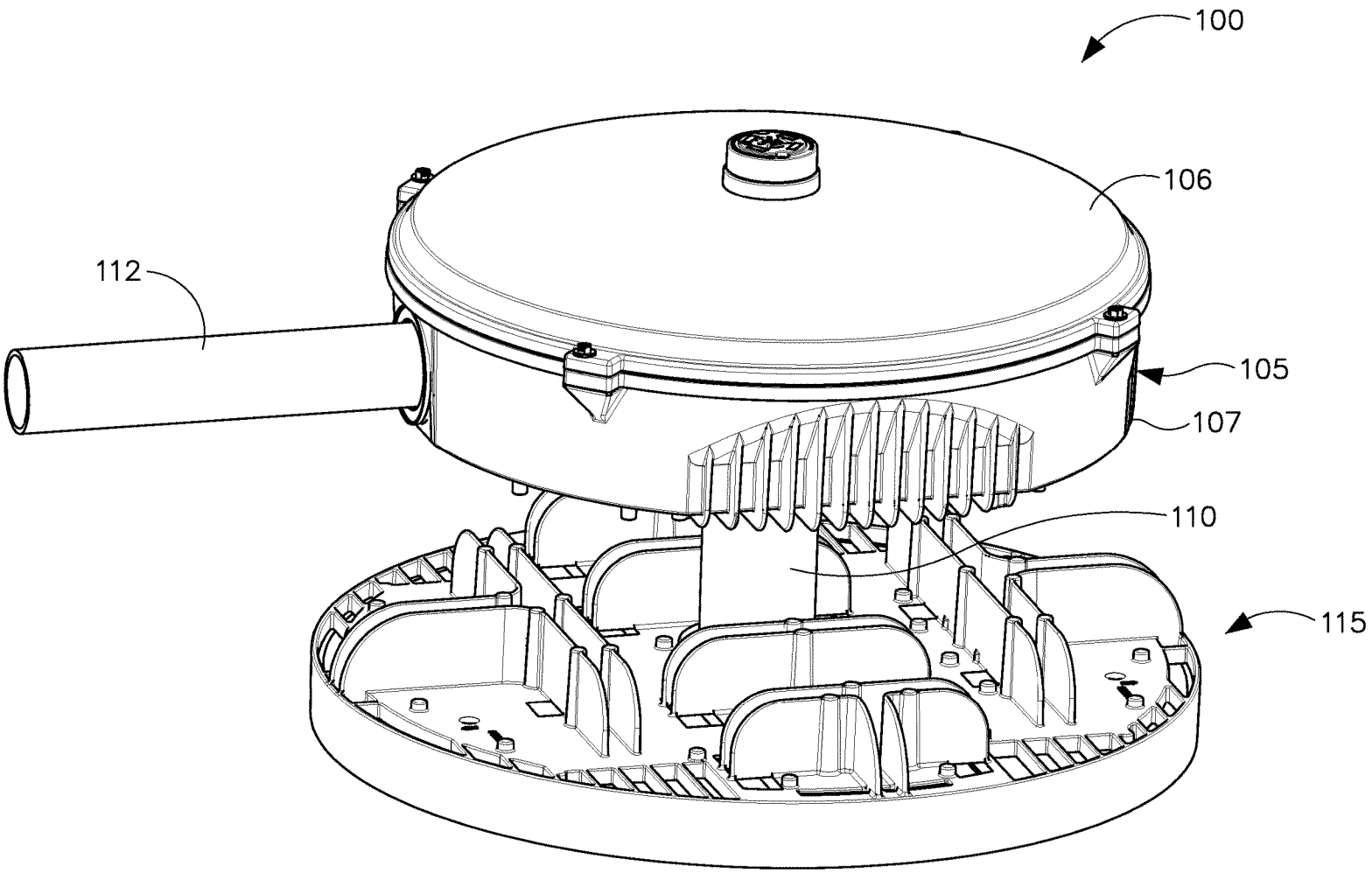
FIG. 1 shows a top perspective view of a high mast luminaire in accordance with certain example embodiments.

The example embodiments discussed herein are directed to high mast luminaires such as the luminaires mounted above roadways. While the example embodiments described herein are in the context of high mast luminaires, it should be understood that the embodiments described herein can apply to a variety of luminaires. For example, the embodiments can be used with luminaires located in any environment (e.g., indoor, outdoor, hazardous, non-hazardous, high humidity, low temperature, corrosive, sterile, high vibration). Further, the luminaires described herein can use one or more of a number of different types of light sources, including but not limited to various light-emitting diode (LED) light sources such as discrete LEDs, LED arrays, chip on board LEDs, and organic LED light sources, as well as other types of light sources. Therefore, the example luminaires described herein, should not be considered limited to a particular type of light source.

In certain example embodiments, the example luminaires are subject to meeting certain standards and/or requirements. For example, the National Electric Code (NEC), the National Electrical Manufacturers Association (NEMA), the International Electrotechnical Commission (IEC), the Federal Communication Commission (FCC), and the Institute of Electrical and Electronics Engineers (IEEE) set standards as to electrical enclosures (e.g., light fixtures), wiring, and electrical connections. As another example, Underwriters Laboratories (UL) sets various standards for light fixtures, including standards for heat dissipation. Use of example embodiments described herein meet (and/or allow a corresponding device to meet) such standards when required.

Any luminaires, or components thereof (e.g., housings or heat sinks), described herein can be made from a single piece (e.g., as from a mold, injection mold, die cast, 3-D printing process, extrusion process, stamping process, or other prototype methods). In addition, or in the alternative, a luminaire (or components thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

A coupling feature (including a complementary coupling feature) as described herein can allow one or more components and/or portions of an example heat sink or other component of a light fixture to become coupled, directly or indirectly, to another portion of the example heat sink or other component of a light fixture. A coupling feature can include, but is not limited to, a snap, Velcro, a clamp, a portion of a hinge, an aperture, a recessed area, a protrusion, a slot, a spring clip, a tab, a detent, and mating threads. One portion of an example heat sink can be coupled to a light fixture by the direct use of one or more coupling features.

In addition, or in the alternative, a portion of a luminaire can be coupled using one or more independent devices that interact with one or more coupling features disposed on a component of the heat sink. Examples of such devices can include, but are not limited to, a pin, a hinge, a fastening device (e.g., a bolt, a screw, a rivet), epoxy, glue, adhesive, tape, and a spring. One coupling feature described herein can be the same as, or different than, one or more other coupling features described herein. A complementary coupling feature (also sometimes called a corresponding coupling feature) as described herein can be a coupling feature that mechanically couples, directly or indirectly, with another coupling feature.

Terms such as "first", "second", "top", "bottom", "side", "distal", "proximal", and "within" are used merely to distinguish one component (or part of a component or state of a component) from another. Such terms are not meant to denote a preference or a particular orientation, and are not meant to limit the embodiments described herein. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 2A:
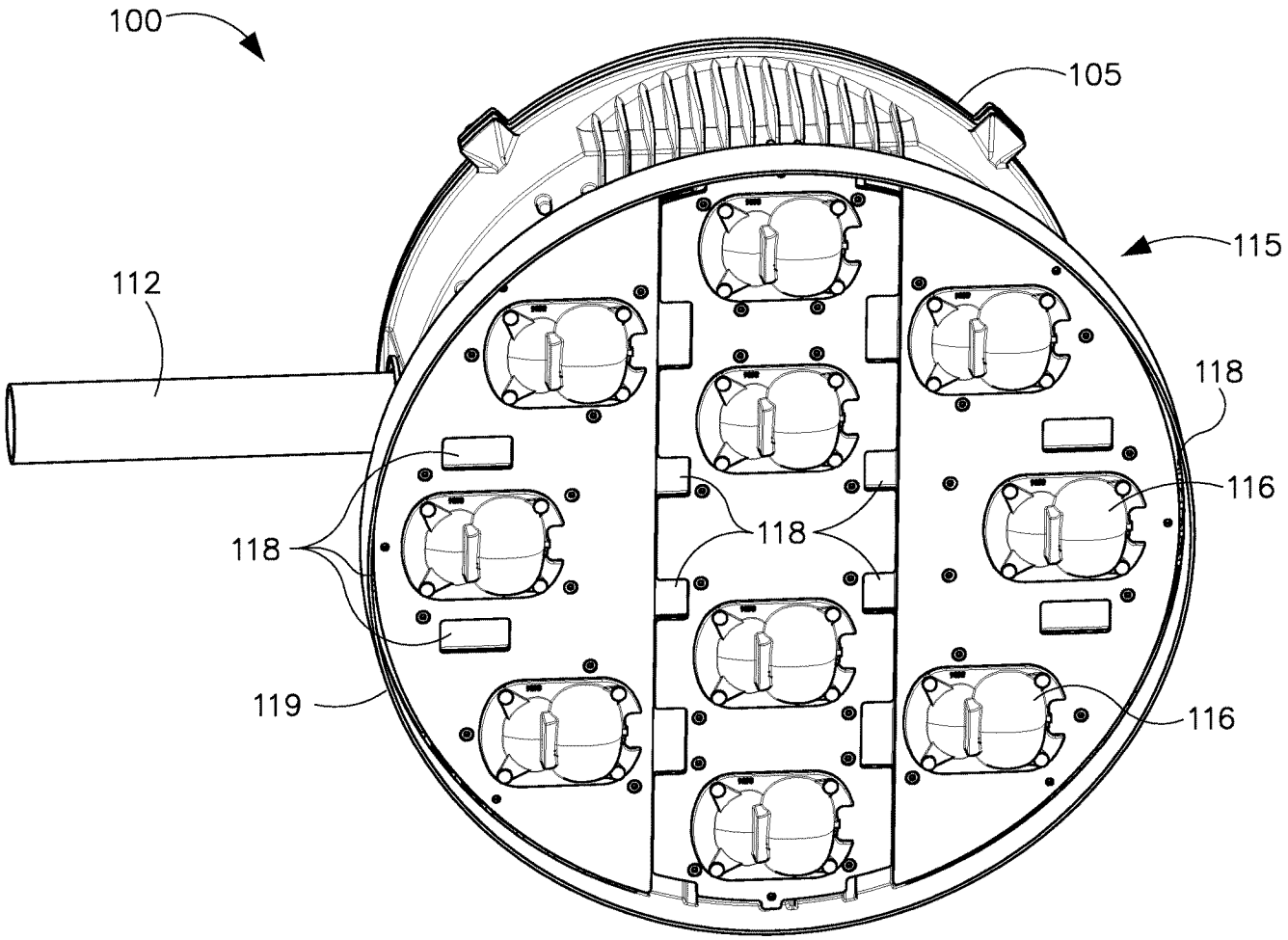
FIG. 2A shows a bottom perspective view of a high mast luminaire in accordance with certain example embodiments.

Referring to FIGS. 1 and 2A, perspective top and bottom views of an example high mast luminaire 100 are shown. The example high mast luminaire 100 comprises a driver housing 105 connected to an LED module 115 by a hollow connector 110. The example high mast luminaire 100 is attached to a pole 112 for mounting, for example, above a roadway. The driver housing comprises a driver housing top 106 and a driver housing base 107. The hollow connector 110 can vary in length depending on the application. For example, in embodiments where the LEDs and the drivers produce a relatively large amount of heat, a longer hollow connector 110 can be used to further separate the driver housing 105 from the LED module 115 so that heat produced by each component does not adversely affect the other component. A longer hollow connector 110 also promotes increased air flow between the driver housing 105 and the LED module 115 to improve cooling. In one example, the length of the hollow connector 110 can vary between 2 and 8 inches.

Figure 2B:
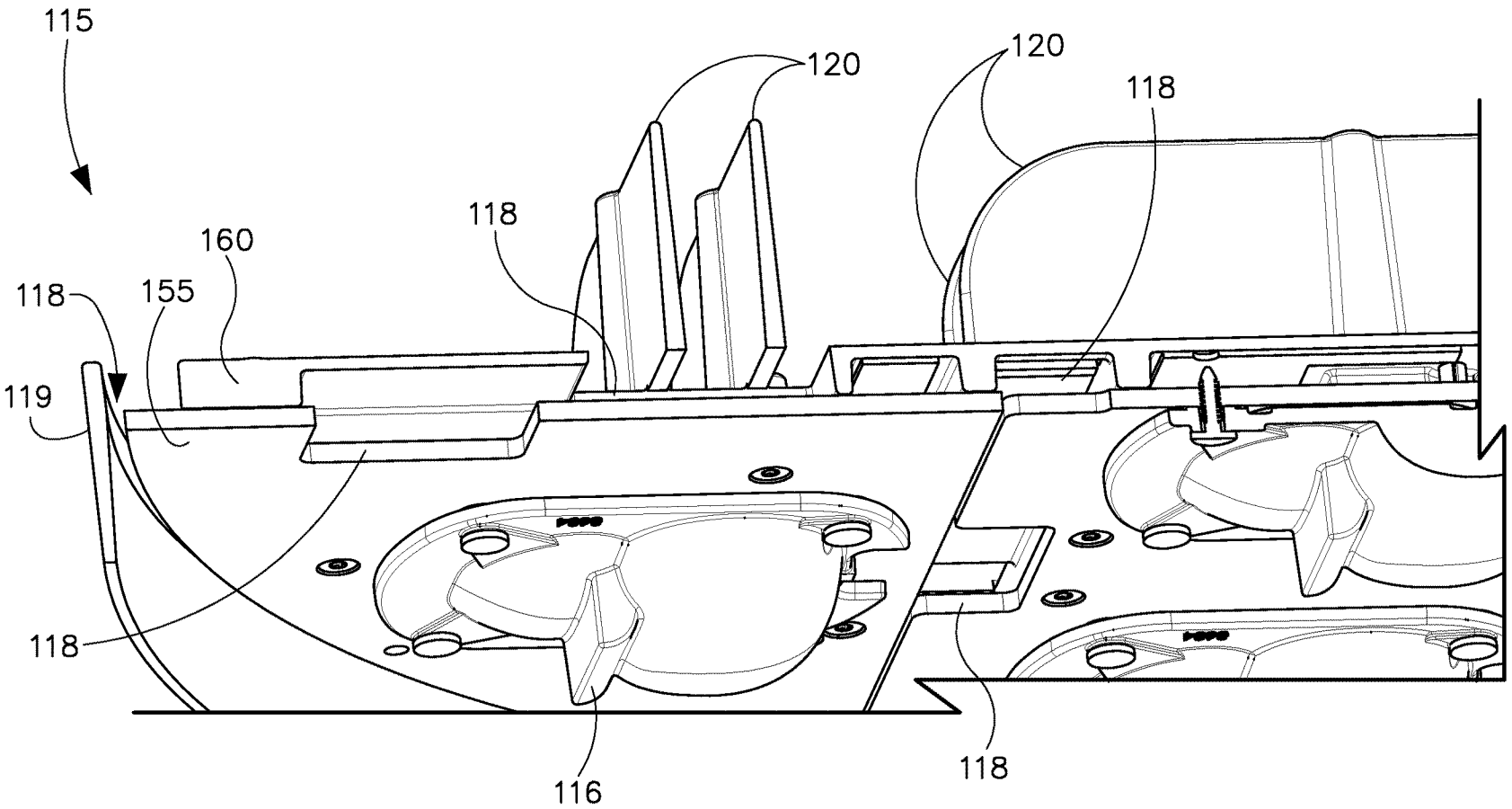
FIG. 2B shows a cross-sectional view of a portion of the LED module of a high mast luminaire in accordance with certain example embodiments.

FIG. 2B is an enlarged cross-sectional partial view of the LED module 115. FIGS. 2A and 2B show vents 118 passing through the LED module 115 to promote cooling of the LED module 115. In the example of FIGS. 2A and 2B, an LED plate 155 covers a majority of the bottom surface of the LED module 115 to minimize light being directed towards the sky, for example, to comply with "dark sky" regulations. An additional feature of the example in FIGS. 2A and 2B is that many of the vents 118 are staggered to further prevent light being directed towards the sky. In other words, the staggered vents 118 have an opening in the LED plate 155 and an offset corresponding opening in the LED casting 160. As such, the vent openings 118 in the LED plate 155 are covered by the LED casting 160 in the area directly above the opening in the LED plate 155 so that light cannot easily pass through the LED module 115 towards the sky.

In the embodiment illustrated in FIGS. 2A and 2B, at least one vent 118 is disposed between each pair of optics 116 to dissipate the heat generated by the one or more LEDs covered by each optic 116. In the example shown in FIGS. 2A and 2B, an additional vent 118 is located along the perimeter of the LED module 115, between the rim 119 and the LED plate 155, and encircling the optics 116. As also shown in the example in FIG. 2B, one or more heat sink fins 120 are disposed across each vent 118 to further assist in dissipating heat generated by the LEDs. As will be readily understood, the number and positions of optics 116, vents 118, and heat sink fins 120 can be varied to accommodate different applications. In one example embodiment, each LED (e.g., the LED 150 shown in FIGS. 10 and 11) consumes between 25 and 80 watts and the arrangement of the vents 118 and heat sink fins 120 reduces the average temperature of the LED module 115 from approximately 120 degrees C. to approximately 94 degrees C. It should also be understood that in other embodiments, the LED plate 155 can have other configurations and may cover less of the bottom surface of the LED module 115.

Figure 3A:
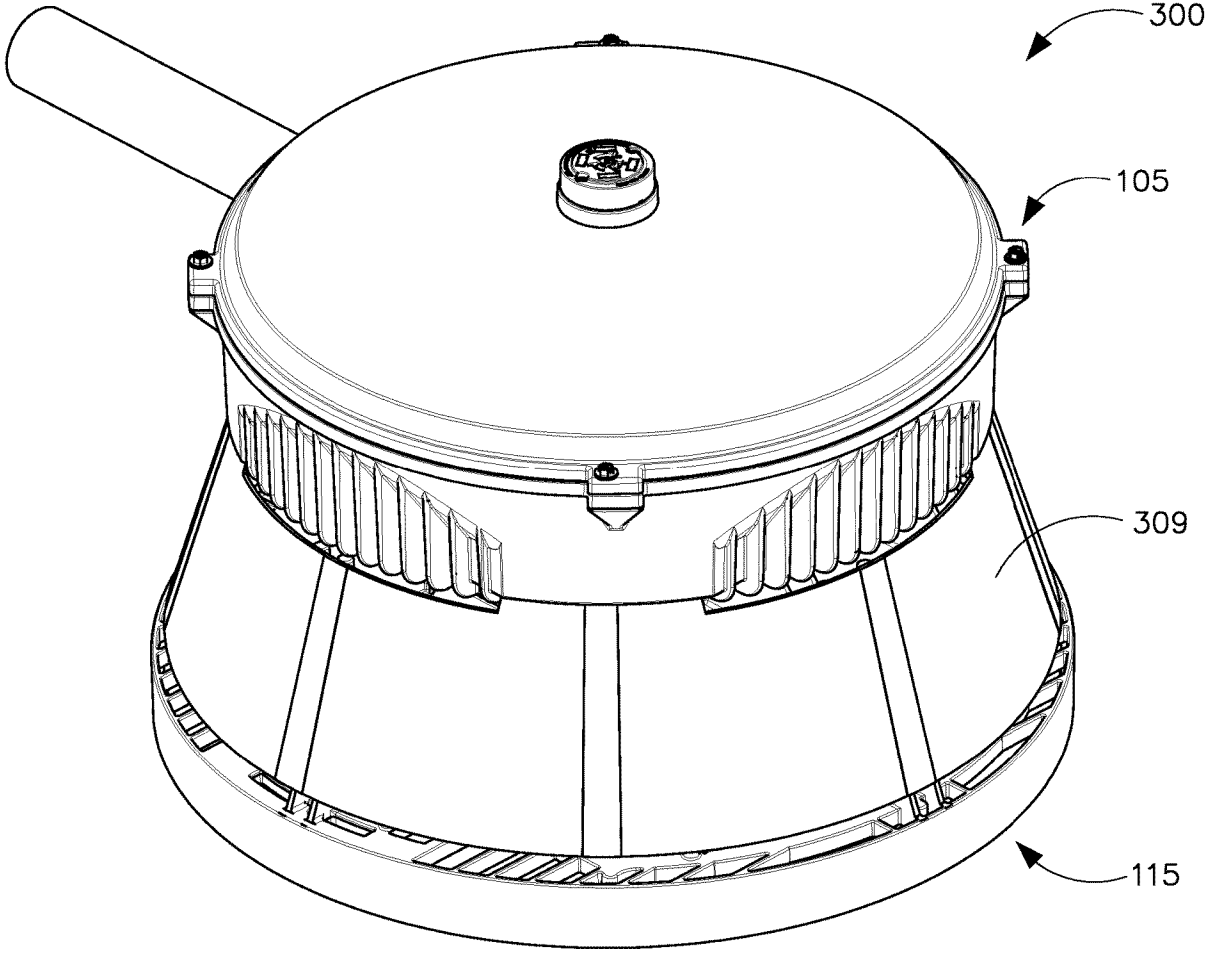
FIGS. 3A and 3B show a high mast luminaire with a shroud in accordance with certain example embodiments.
Figure 3B:
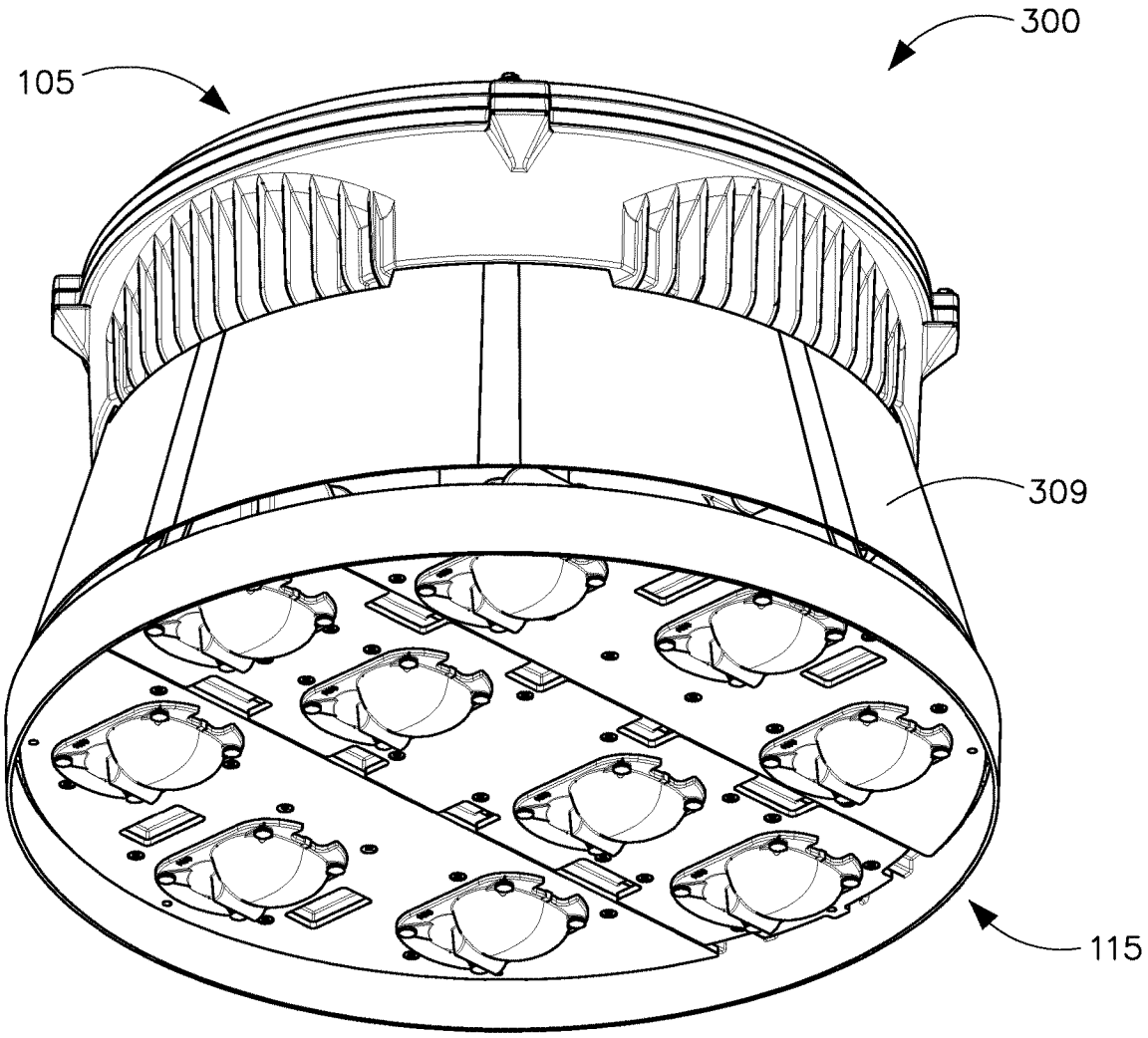

FIGS. 3A and 3B illustrate an alternate embodiment of a high mast luminaire 300. The alternate high mast luminaire 300 comprises a driver housing 105, an LED module 115, and a hollow connector 110 similar to those described in connection with FIGS. 1 and 2. However, the alternate embodiment illustrated in FIGS. 3A and 3B also comprises a shroud 309 that covers the hollow connector 110, for example, for aesthetic purposes.

Figure 4:
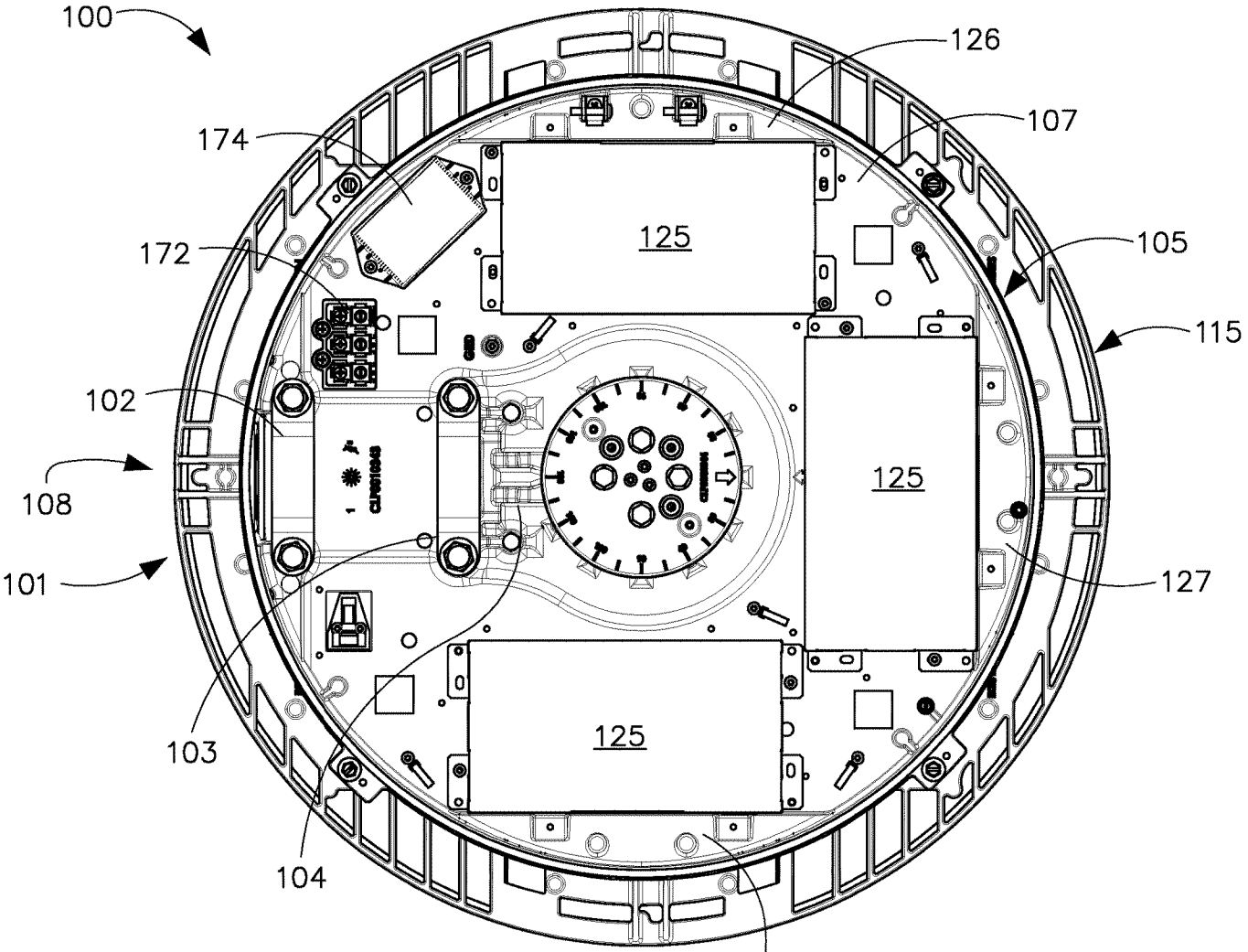
FIG. 4 shows an interior view of the driver housing of a high mast luminaire in accordance with certain example embodiments.
Figure 5:
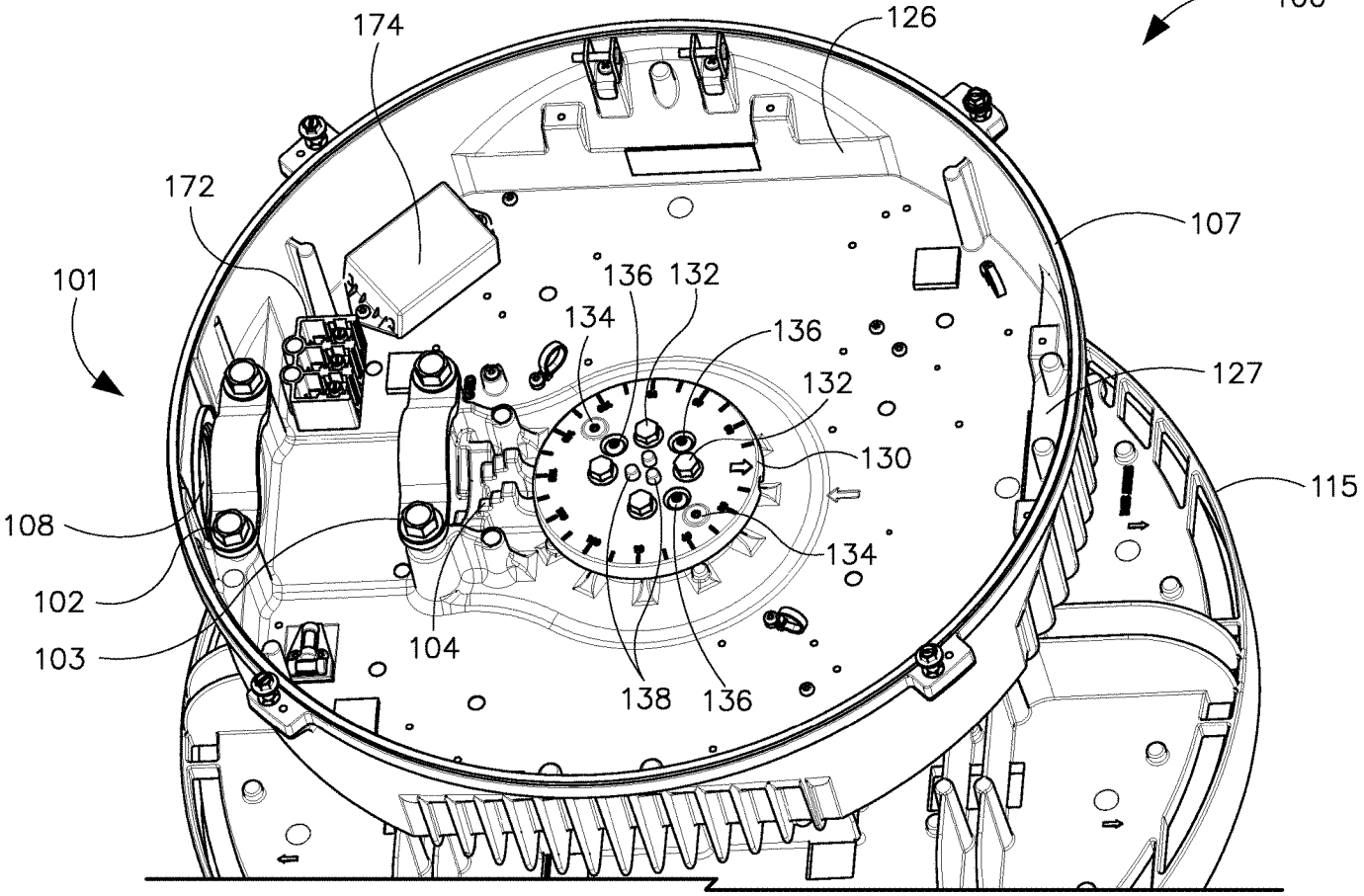
FIG. 5 shows another interior view of the driver housing of a high mast luminaire in accordance with certain example embodiments.
Figure 6:
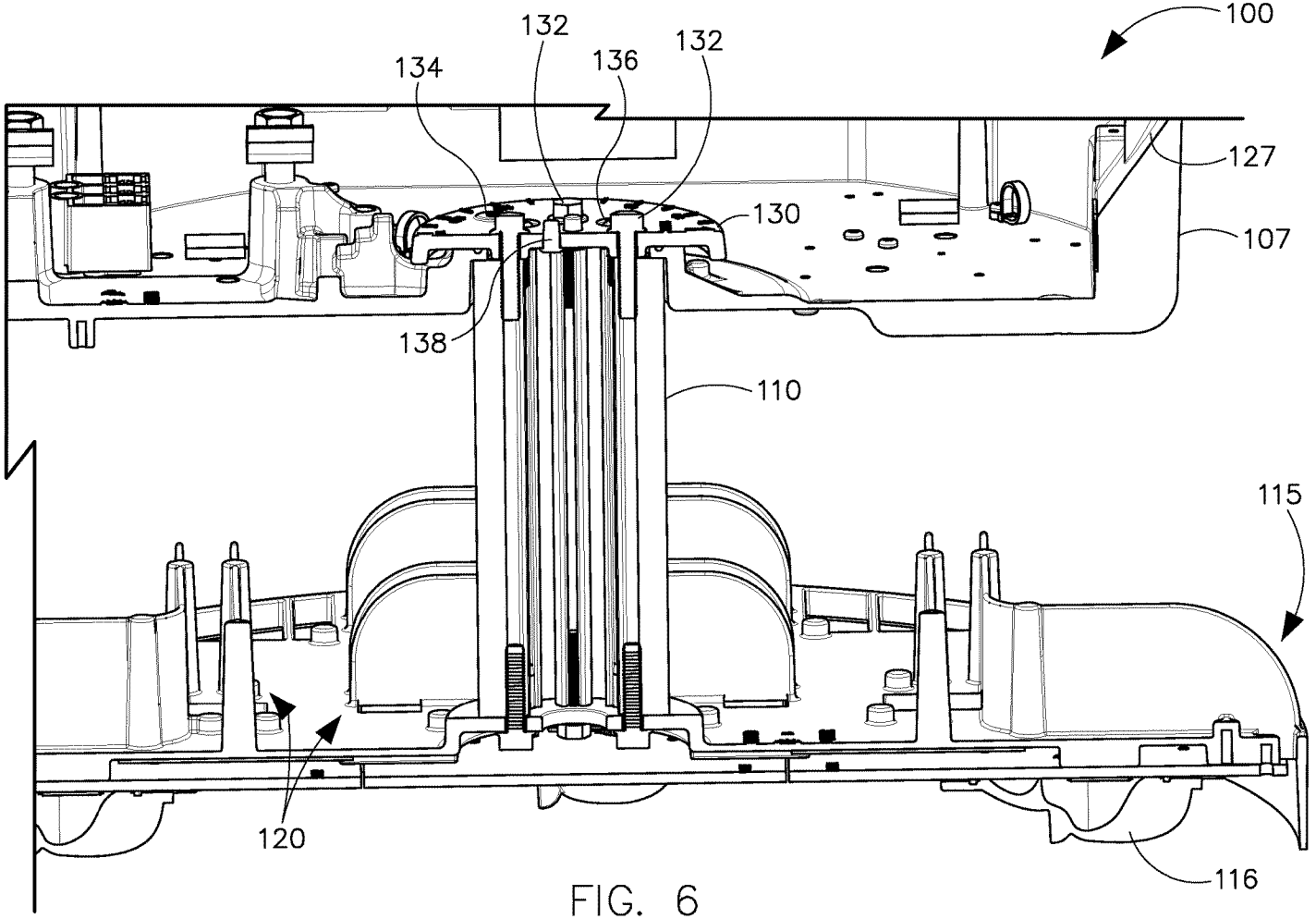
FIG. 6 shows a partial cross-sectional view of a high mast luminaire in accordance with certain example embodiments.
Figure 7:
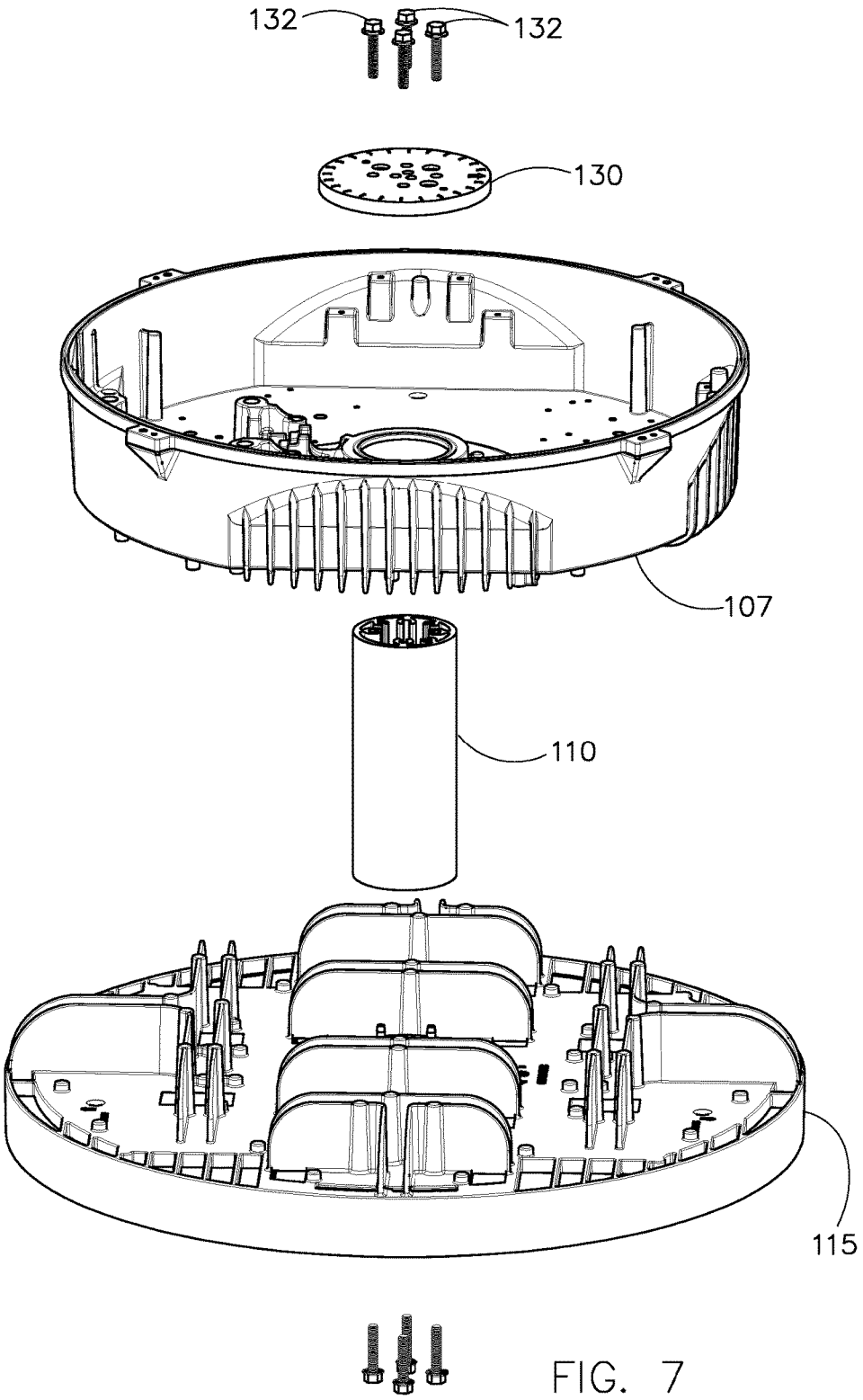
FIG. 7 shows a partial exploded view of a high mast luminaire in accordance with certain example embodiments.

FIGS. 4 and 5 illustrate top plan and top perspective views, respectively, of the driver housing 105 of an example high mast luminaire. FIG. 4 shows three drivers 125 located in the driver housing base 107. The drivers 125 receive power (e.g., line power) via a terminal block 172 and a surge protector 174. In alternate embodiments, the luminaire may have fewer or more drivers and they may be mounted in other positions. As illustrated in the example in FIGS. 4 and 5, the driver housing base 107 comprises three side walls 126, 127, and 128 wherein the interior surface of the sidewall is flat so that each of the drivers 125 can be mounted directly against the flat interior surface of each sidewall 126, 127, and 128 to optimize the transfer of heat from the drivers 125 to the driver housing base 107. This arrangement can also be seen in the cross-section view shown in FIG. 9. As illustrated in FIG. 5, the outer surface of the three side walls 126, 127, and 128 of the driver housing base 107 comprise heat sink fins to assist with heat dissipation.

FIGS. 4 and 5 also show an example mounting assembly 101 of the LED module 115. The mounting assembly 101 comprises an aperture 108 in the side of the driver housing base 107, the aperture 108 for receiving a mounting component such as the pole 112. The mounting assembly 101 also comprises a pair of clamps 102 and 103 and a receiving end 104. The receiving end 104 has a series of step features designed to receive mounting components, such as pole 112, having varying dimensions.

FIG. 5 illustrates the driver housing base 107 with the drivers removed. FIG. 5 shows an example rotatable cap 130. Rotatable cap 130 comprises a first set of apertures for receiving hexagonal bolts 132 which are used to fasten the rotatable cap 130 to the hollow connector 110. Rotatable cap 130 also comprises a second set of apertures for receiving rotational set screws 134. Rotatable cap 130 further comprises one or more third apertures for receiving a tamper-proof security screw 136. Lastly, rotatable cap 130 further comprises one or more fourth apertures for receiving one or more wiring grommets 138. It should be understood that the different types of fasteners described and shown in connection with the rotatable cap 130 are simply examples and that in alternate embodiments other types of fasteners can be used.

Referring to FIGS. 5, 6, 7, and 8, the installation of the high mast luminaire using the rotatable cap can be further described. As illustrated in FIG. 2, each of the optics 116 is biased to direct light at a particular angle. In other words, each optic 116 is asymmetric and is designed to direct at least a majority of light from an LED towards the side of the optic that has a wider rounded surface. Because each of the optics 116 is oriented in the same direction, it is advantageous to be able to rotate the LED module 115 to direct light in the desired direction, for example towards a roadway on one side of the luminaire. During installation or maintenance of the luminaire, the rotatable cap 130 permits rotation of the hollow connector 110 and the LED module 115 to direct light in the desired direction while the driver housing 105 remains attached to a pole 112 and does not rotate. The apertures in the rotatable cap 130 are asymmetric so that the rotatable cap 130 can only be installed in the correct position.

Figure 8:
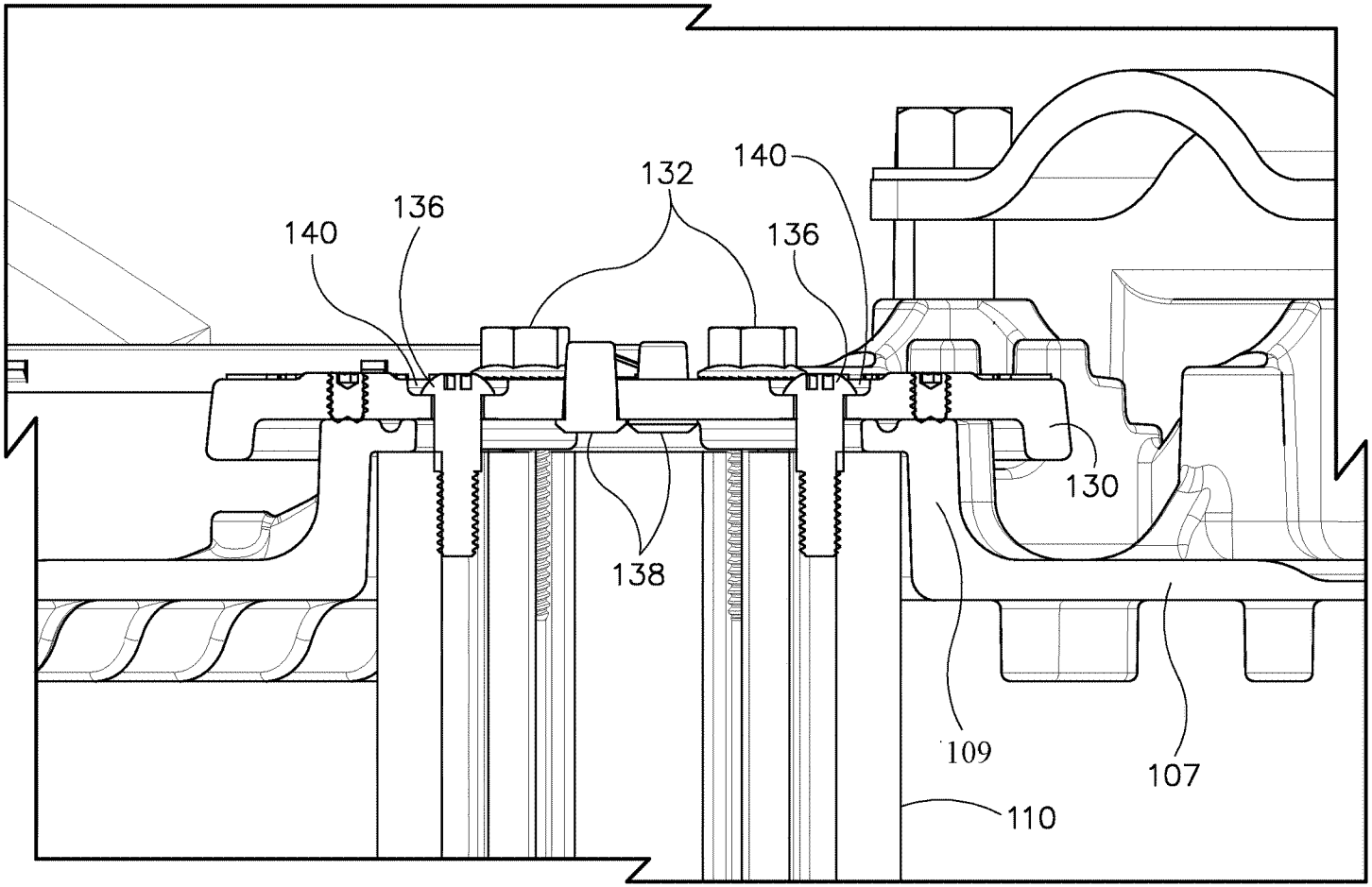
FIG. 8 shows a partial cross-sectional view of a high mast luminaire in accordance with certain example embodiments.

During installation or maintenance, the hexagonal bolts 132 and the rotational set screws 134 are loosened so that the rotatable cap 130 can be rotated to position the LED module 115 at the desired angle. As shown in the example in FIG. 8, the rotatable cap 120 rests on an inner wall 109 of the driver housing base 107. As further shown in the example of FIGS. 6 and 8, the hexagonal bolts 132 and the tamper-proof security screws 136 fasten to the hollow connector 110, while the rotational set screws 134, located closer to the perimeter of the rotatable cap 130, fasten to the top of the inner wall 109. Although the hexagonal bolts 132 and the rotational set screws 134 are loose, the tamper-proof security screws 136 can only be partially unfastened and serve as a safety feature. The tamper-proof security screws 136 are designed so that they are fastened during the manufacturing process and cannot be completely unfastened without the proper tool. The tamper-proof security screws 136 are designed so that the rotatable cap 130 cannot be completely separated from the hollow connector 110 and the LED module 115 when the hexagonal bolts 132 and the rotational set screws 134 are loosened. As can be seen in FIG. 8, the tamper-proof security screws 136 are designed such that when they are partially loosened there is a gap 140 between the head of the tamper-proof screw 136 and the rotatable cap 130 thereby permitting enough flexibility to rotate the rotatable cap 130 on the inner wall 109 to the desired angle.

Arrows and angle measurement markings are included on the rotatable cap 130 and the driver housing base 107 to assist the installer in selecting the desired angle of rotation. Once the rotatable cap 130 is placed at the desired angle so that light is emitted from the LED module 115 in the designated direction, the hexagonal bolts 132 attached to the hollow connector 110 are tightened. Lastly, the rotational set screws 134 are tightened against the top of the inner wall 109 as an additional measure to ensure the rotatable cap 130 will not rotate.

Figure 9:
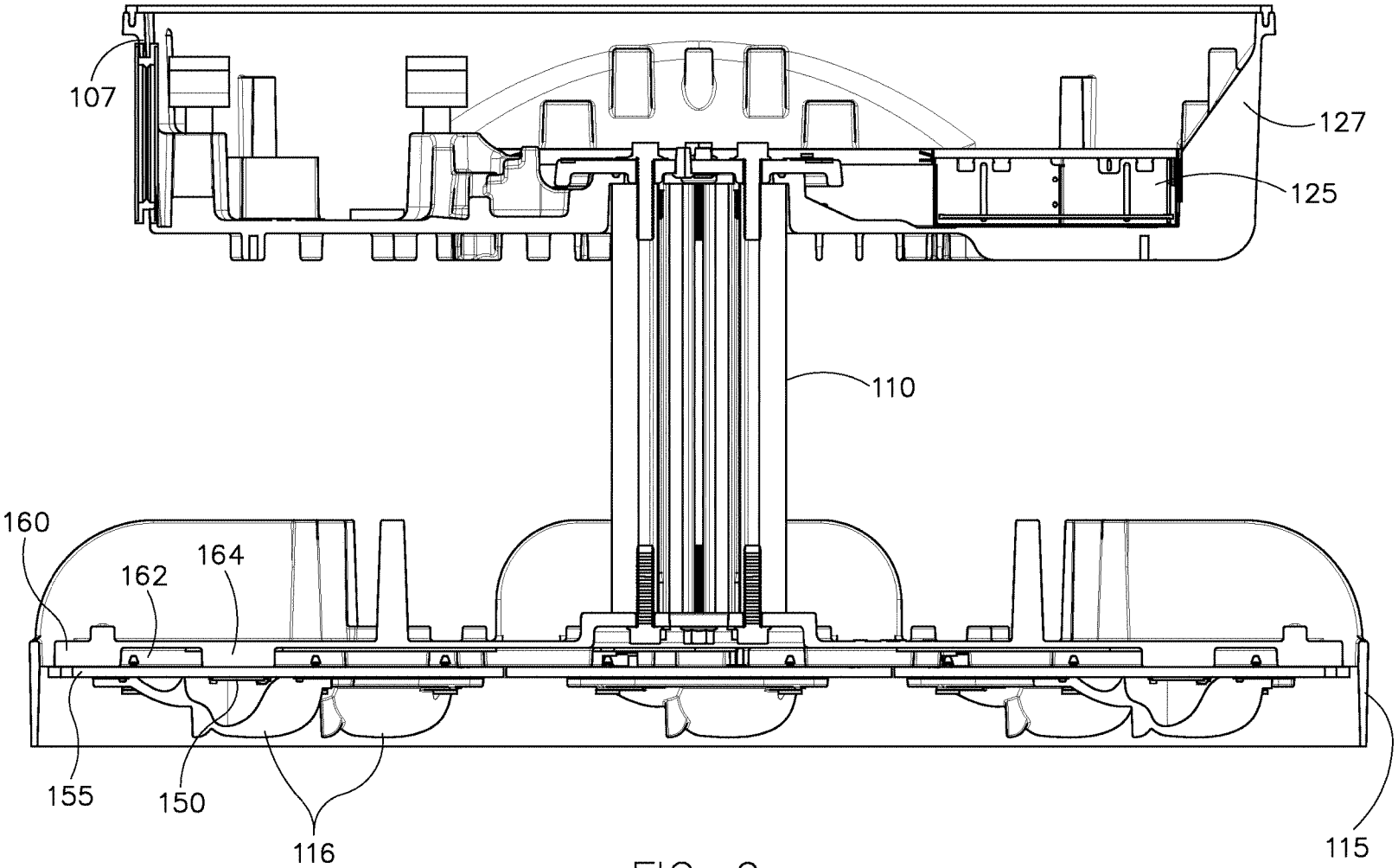
FIG. 9 shows another cross-sectional view of a high mast luminaire in accordance with certain example embodiments.
Figure 10:
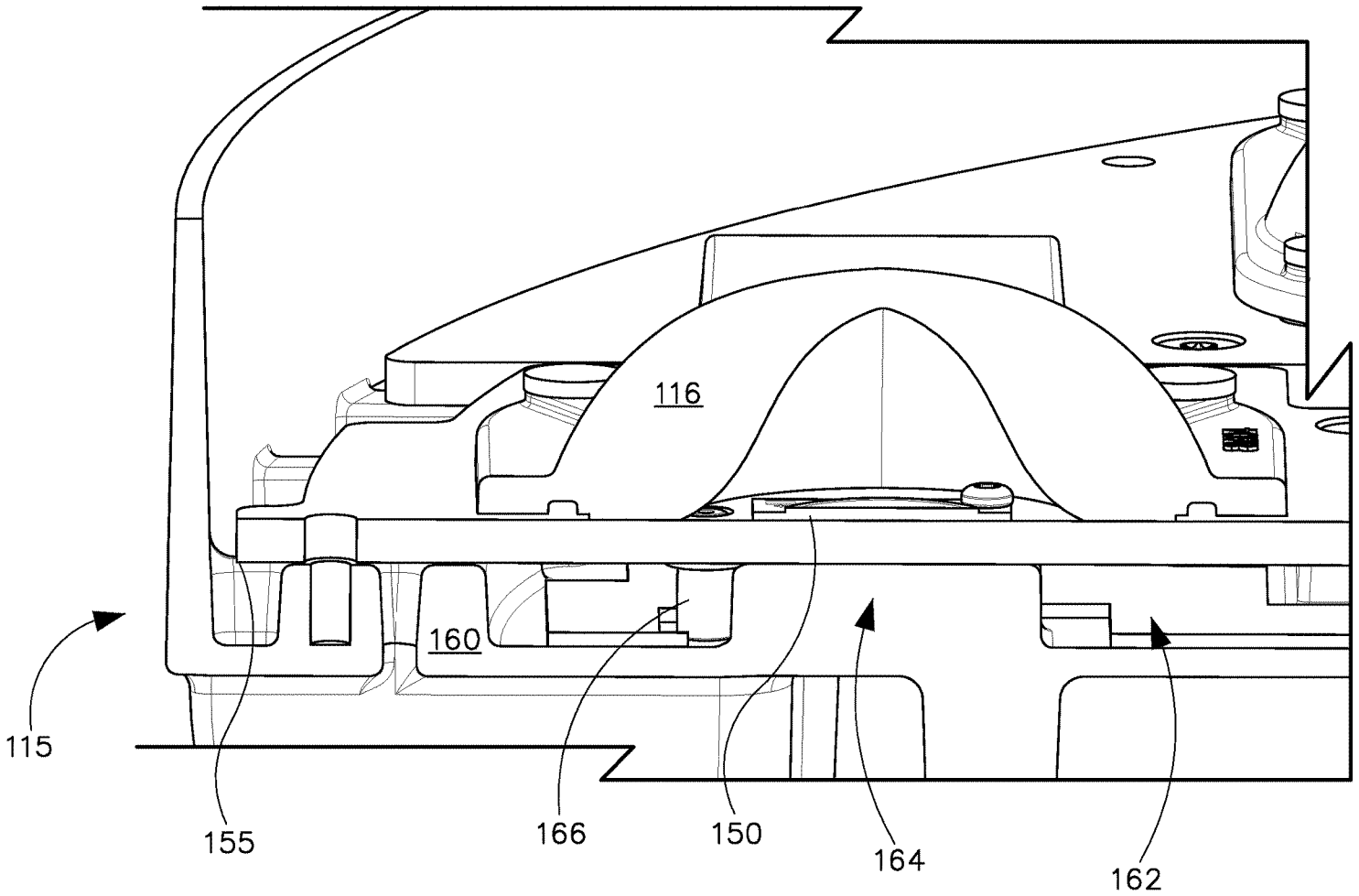
FIG. 10 is an inverted enlarged partial cross-sectional view of an optic and LED in accordance with certain example embodiments.
Figure 11:
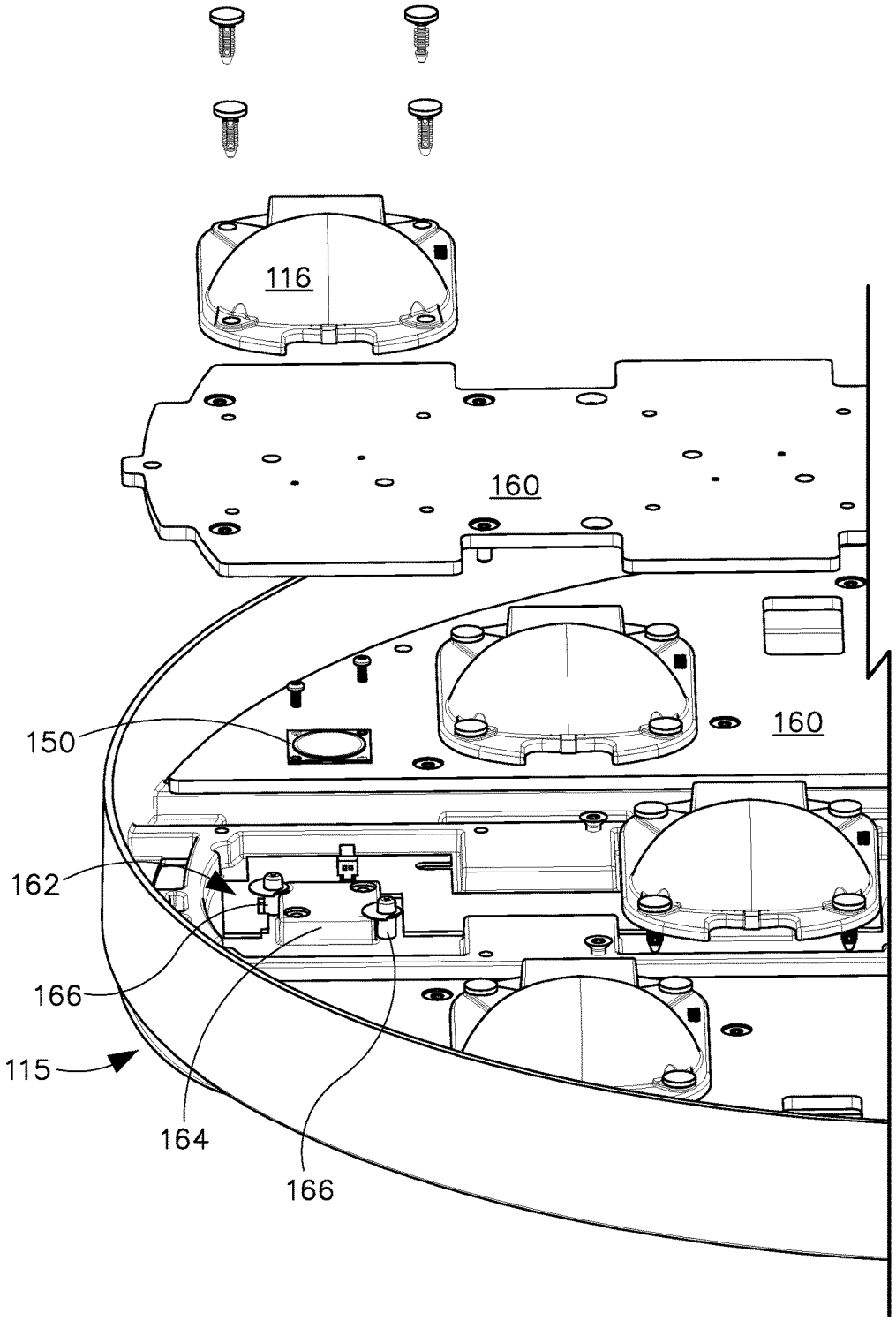
FIG. 11 is an inverted enlarged partial exploded view of the LED module of a high mast luminaire in accordance with certain example embodiments.

Additional advantages of the example embodiments of high mast luminaires are shown in FIGS. 9-11. In particular, the LED module 115 is designed to optimize heat transfer from the LEDs 150 located under each optic 116. The LEDs 150 are mounted on an LED plate 155 as shown in FIGS. 9 and 10. The LED plate 155 is attached to the LED casting 160 of the LED module 115. The LED casting 160 comprises mounting pads 164 and wiring cavities 162. The mounting pads 164 are positioned directly behind the LEDs 150 to facilitate the transfer of heat from the LEDs 150 across the LED plate 155 and to the mounting pads 164. The LED casting 160 absorbs the heat via the mounting pads 164 and dissipates the heat via the vents 118 and heat sink fins 120.

The wiring cavities 162 accommodate grommets 166 on each side of the mounting pad 164 so that the two lead wires from the LED 150 can pass through a grommet 166 on each side of the mounting pad 164 without interfering with the direct contact of the LEDs to the mounting pad 164 and the desired heat transfer. FIG. 11 shows the aforementioned features, but with the LED plate 155 hidden from view to illustrate the mounting pad 164 and the wiring cavities 162. The lead wires from the LED 150 connect to conductors in the wiring cavities 162 and the conductors extend through the hollow connector 110 and through the grommets 138 to the driver housing 105 to provide power from the one or more drivers 125.

Many modifications and other embodiments set forth herein will come to mind to one skilled in the art having the benefit of the teachings presented in the foregoing descriptions and the associated drawings. Therefore, it is to be understood that the example embodiments are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A luminaire comprising:

a light emitting diode (LED) module comprising:

a plurality of optics, each optic of the plurality of optics covering one or more LEDs, and each optic of the plurality of optics located adjacent to at least one vent that passes through the LED module;

an LED plate on which the plurality of optics and the one or more LEDs are mounted; and an LED module casting, the LED module casting comprising mounting pads and wiring cavities;

a driver housing comprising a driver and a rotatable cap for rotating the LED module; and a hollow connector that connects the LED module and the rotatable cap of the driver housing.

2. The luminaire of claim 1, wherein the driver housing further comprises a side aperture for receiving a pole for mounting the luminaire above a roadway.

3. The luminaire of claim 1, wherein the rotatable cap comprises a first set of apertures for receiving a plurality of fasteners that pass through the rotatable cap and fasten to the hollow connector.

4. The luminaire of claim 3, wherein the rotatable cap comprises a second set of apertures for receiving rotational set screws for fastening the rotatable cap to the driver housing after the plurality of fasteners are fastened, the rotational set screws preventing rotation of the rotatable cap.

5. The luminaire of claim 1, wherein the rotatable cap comprises at least one third aperture for receiving a tamper-proof security screw that attaches the rotatable cap to the hollow connector.

6. The luminaire of claim 1, wherein the rotatable cap comprises at least one fourth aperture for receiving a wiring grommet through which one or more wires can pass for connecting to the driver.

7. The luminaire of claim 1, wherein the rotatable cap can rotate up to 180 degrees in one direction and up to 179 degrees in the opposite direction.

8. The luminaire of claim 1, wherein the driver housing comprises at least one wall having a flat interior surface against which the driver can be placed.

9. The luminaire of claim 8, wherein the at least one wall of the driver housing further comprises heat sink fins disposed on an exterior surface of the at least one wall.

10. The luminaire of claim 1, wherein the LED module comprises a plurality of heat sink fins wherein at least one heat sink fin of the plurality of heat sink fins is disposed over each vent.

11. The luminaire of claim 10, wherein the plurality of heat sink fins are oriented in different directions.

12. The luminaire of claim 1, wherein the one or more LEDs are aligned with the mounting pads.

13. The luminaire of claim 1, wherein the wiring cavities comprise wiring for connecting the one or more LEDs to the driver.

14. A luminaire comprising:

a driver housing comprising a driver, a rotatable cap, and a mounting assembly;

a light emitting diode (LED) module comprising a plurality of optics, each optic of the plurality of optics covering one or more LEDs; and a hollow connector that connects the LED module and the driver housing, the hollow connector and the LED module rotatable by the rotatable cap, wherein the LED module further comprises wiring cavities for receiving wiring that connects the one or more LEDs with the driver via the hollow connector.

15. The luminaire of claim 14, wherein the plurality of optics are biased to emit light from the one or more LEDs in a designated direction.

16. The luminaire of claim 14, wherein the LED module further comprises at least one vent adjacent to each optic of the plurality of optics, each vent traversed by at least one heat sink fin.

17. The luminaire of claim 14, wherein the mounting assembly of the driver housing comprises at least one clamp for securing a mounting post.

18. The luminaire of claim 14, wherein the rotatable cap comprises a plurality of apertures for receiving a plurality of fasteners that fasten the rotatable cap to the hollow connector.

19. The luminaire of claim 14, wherein the LED module further comprises a rim along a perimeter of the LED module.

20. The luminaire of claim 14, wherein each optic of the plurality of optics is asymmetric.

21. The luminaire of claim 14, wherein the LED module further comprises a plurality of mounting pads, wherein each LED of the one or more LEDs is aligned with a mounting pad of the plurality of mounting pads.

22. The luminaire of claim 14, wherein the LED module further comprises an LED plate on which the plurality of optics are mounted.

23. The luminaire of claim 22, wherein the LED module further comprises an LED module casting to which the LED plate is attached.

24. The luminaire of claim 23, wherein the LED module further comprises a plurality of heat sink fins that dissipate heat from the LED module casting.

25. The luminaire of claim 14, further comprising a shroud that covers the hollow connector.

* * * * *